US010561242B1

(12) United States Patent
Ignacio

(10) Patent No.: US 10,561,242 B1
(45) Date of Patent: Feb. 18, 2020

(54) SHELVING BRACKET

(71) Applicant: Warren E. Ignacio, Dracut, MA (US)

(72) Inventor: Warren E. Ignacio, Dracut, MA (US)

( * ) Notice: Subject to any disclaimer, the term of this patent is extended or adjusted under 35 U.S.C. 154(b) by 0 days.

(21) Appl. No.: 16/165,025

(22) Filed: Oct. 19, 2018

(51) Int. Cl.
*A47B 96/07* (2006.01)
*A47B 57/04* (2006.01)

(52) U.S. Cl.
CPC ..... *A47B 96/07* (2013.01); *A47B 57/04* (2013.01)

(58) Field of Classification Search
CPC ..... A47B 57/045; A47B 57/04
See application file for complete search history.

(56) References Cited

U.S. PATENT DOCUMENTS 1,090,687 A * 3/1914 Coon ..... A47B 57/045 248/242
1,102,480 A * 7/1914 Davis ..... A47B 57/045 248/242
3,193,233 A * 7/1965 Wichser ..... E04G 5/06 248/240.3
3,994,462 A 11/1976 Shine
5,459,967 A 10/1995 Bodtker
5,662,256 A * 9/1997 Bryan ..... B60R 9/06 211/18
5,725,190 A 3/1998 Cuthbertson
6,053,465 A * 4/2000 Kluge ..... A47B 61/003 248/201
7,527,232 B2 5/2009 Frampton
7,874,536 B2 1/2011 Groover
8,146,873 B2 * 4/2012 Johnson ..... A47B 96/061 248/201
8,337,037 B2 12/2012 Hopkins
8,397,458 B2 3/2013 Tedesco
2003/0188672 A1 * 10/2003 Parent ..... A47B 5/006 108/134
2009/0250088 A1 * 10/2009 Gibbons ..... A61H 3/02 135/73

OTHER PUBLICATIONS

Abrecht Bracket Co. Advertisement (online).

* cited by examiner

*Primary Examiner* — Amy J. Sterling
(74) *Attorney, Agent, or Firm* — Bookstein IP Law

(57) ABSTRACT

A shelving bracket adapted to be mounted to a non-vertical is adjustable to support a shelf in a horizontal orientation. The bracket may include support to receive and support transversely extending clothes hanging or similar poles.

11 Claims, 4 Drawing Sheets

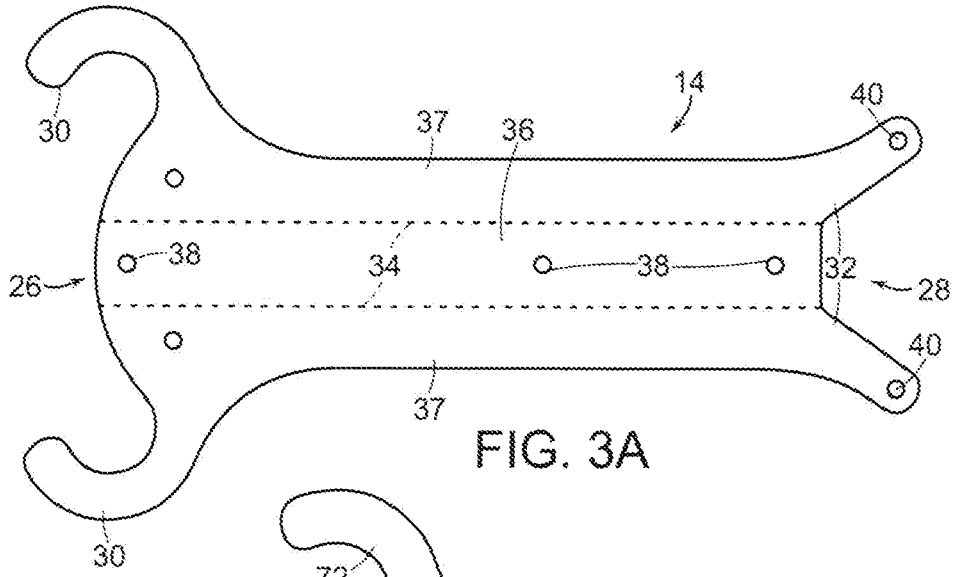
FIG. 3A
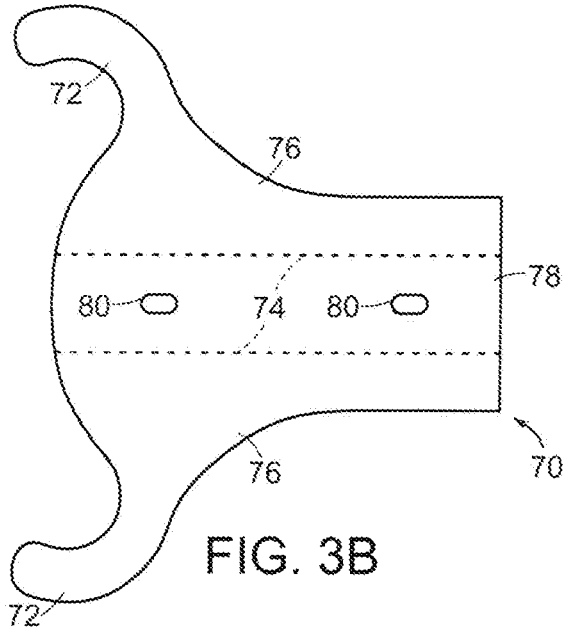
FIG. 3B
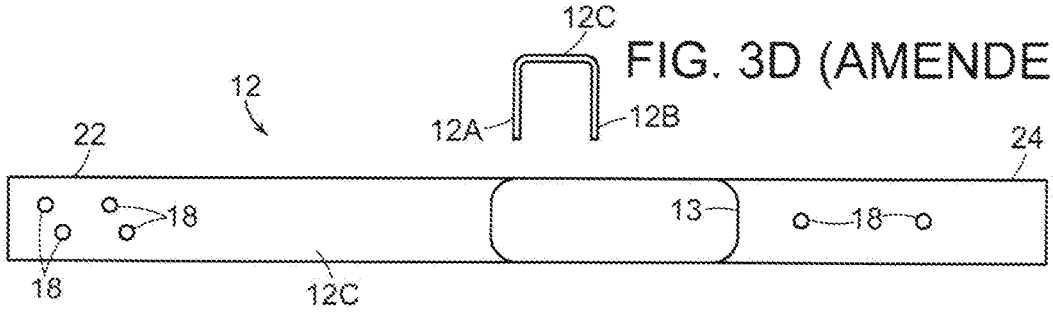
FIG. 3D (AMENDED)
FIG. 3C

SHELVING BRACKET

FIELD

The invention relates to shelving and clothes hanging brackets.

BACKGROUND

The presence of sloped walls and angled or non-vertical surfaces in buildings presents limitations in the ability to store objects on bracket-supported shelving by securing the brackets to the non-vertical surface. Shelving brackets adapted to be attached to a wall typically are configured with the shelf support at right angles to the bracket leg to be attached to the wall. Such shelf brackets cannot support a shelf horizontally when the wall is oriented to be non-vertical, for example, in an attic, beneath a staircase or in other angled surfaces. Although some shelving brackets are adjustable, for example, to allow a board or shelf to be flat-folded against a wall, they do not enable attachment so as to provide a horizontal shelving surface attached to a sloped wall or non-vertical surface. It would be desirable to provide such an adjustable shelving bracket.

SUMMARY

A shelving bracket is provided that includes a wall-mounting leg, a shelf-supporting leg pivoted to the mounting leg and an adjustable-length bracing leg, pivoted at one end to the shelf support leg and at the other end to the mounting leg. The range of adjustment of the adjustable bracing leg is such as to allow the shelf-support leg to extend horizontally when the mounting leg is attached to a sloping wall or other surface that is angled with respect to the vertical. The adjustable brace leg includes locking elements by which the bracket can be locked in a wide range of configurations such that the angle between the mounting leg and the shelf-supporting leg is adjustable and obtuse and may be used with a range of angled sloping surfaces. In addition to providing a horizontal shelf support, the bracket can be formed to include pole supporting hooks to receive clothes poles.

DRAWINGS

The various objects and advantages of the invention will be appreciated more fully from the following description, with reference to the accompanying drawings in which:

FIG. 3A is a plan view of one embodiment of the shelf-support leg while still in flat, unformed configuration;

FIG. 3B is a plan view of an embodiment of a lower pole support while still in flat, unformed configuration;

FIG. 3C is a plan view of a mounting leg of the bracket;

FIG. 3D is an end view of the mounting leg;

ILLUSTRATIVE EMBODIMENT

Figure 1:
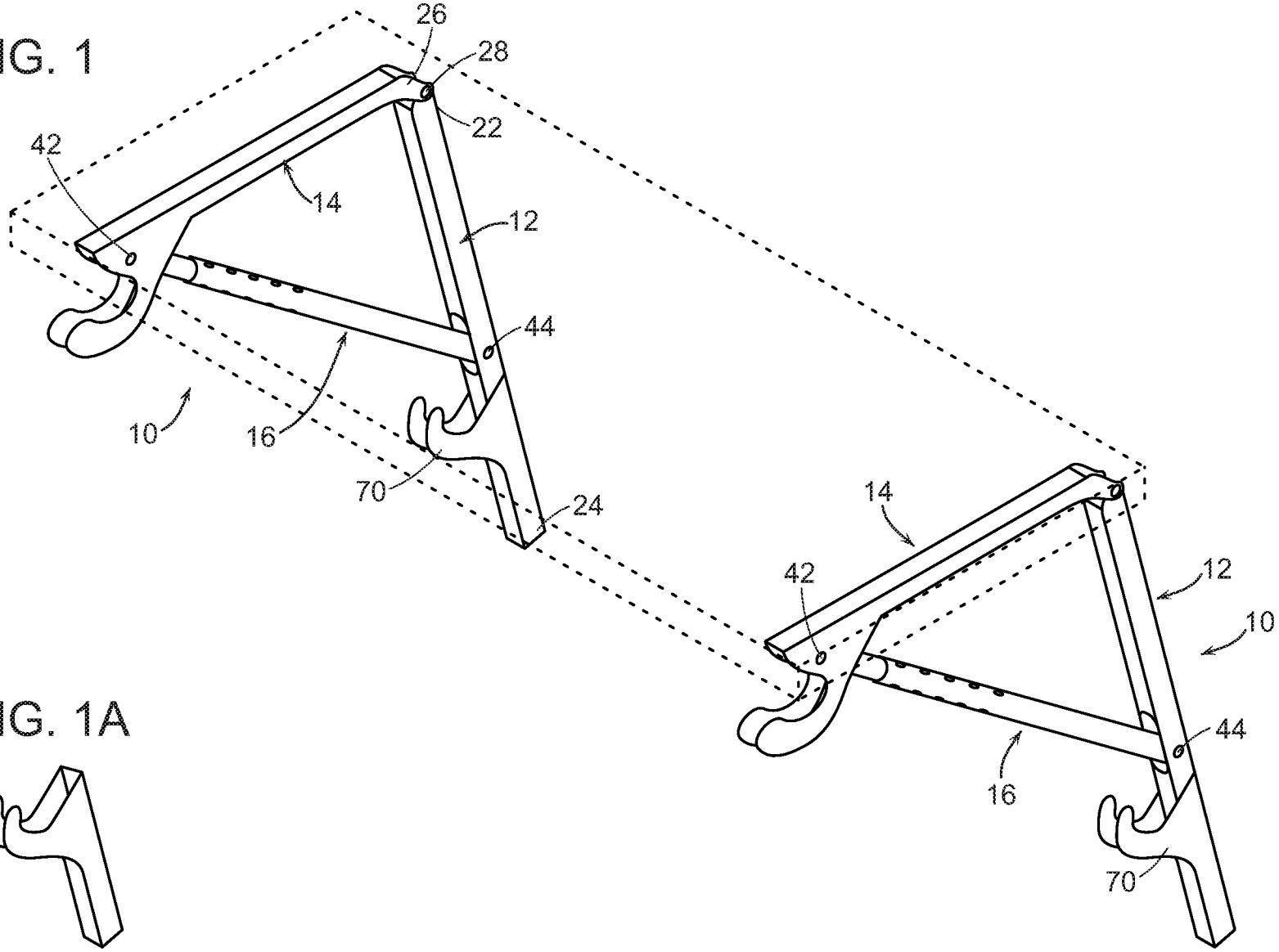
FIG. 1 is an isometric illustration of an embodiment of a pair the brackets with a shelf and a pair of clothes-supporting poles shown in phantom.
Figure 1A:
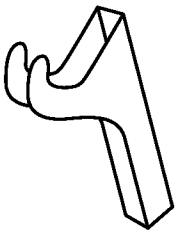
FIG. 1A is an illustration of a pole hook that, optionally, can be incorporated into the bracket.

FIG. 1 illustrates a pair of shelving brackets 10 embodying the invention. Each shelving bracket 10 includes a mounting leg 12, a shelf-supporting leg 14 and a bracing leg 16. The mounting leg 12 may be formed from suitable metal and preferably is channel-shaped in cross section as shown in FIG. 3D, having side walls 12A, 12B and a web wall 12C. The web wall 12C may be provided with holes 18 along its length to enable the mounting leg to be securely fastened to a structurally sound portion of a wall 20, for example, to a stud or a rafter or to any other structural surface that makes an angle to the vertical. The mounting leg 12 may be considered to have upper and lower ends 22, 24. In the illustrative embodiment, the mounting leg is attached with its open channel facing the angled wall. In that mounting, the web wall 12C also may have an elongate opening 13 toward the lower end 24 to receive the lower end of the bracing leg 16, as described below. The mounting leg could be mounted with its channel facing outwardly from the wall and in that case the opening may be omitted.

The shelf-supporting leg 14 is pivoted at its inner end 26 to the upper end 22 of the mounting leg 12 at a first pivot pin 28 and is arranged so that the angle between the mounting leg 12 and shelf-supporting leg 14 can assume an obtuse angle, thus enabling the shelf-supporting leg 14 to be oriented in a horizontal position when the mounting leg is attached to a sloping wall or angled surface. The shelf-supporting leg 14 also is channel-shaped in cross-section to define a shelf support surface 36 and a pair of side skirts 37 and may be formed from flat sheet metal in a pattern as shown in FIG. 3A. The shelf-supporting leg 14 may be considered as having a forward end 26 and a rearward end 28 with the forward end formed to define a pair of mirror-image hooks 30 and the rearward end formed to define a pair of diverging tangs 32. The shelf-supporting leg is formed to its channel cross-section by bending the sheet metal pattern along a pair of parallel lines, indicated in phantom in FIG. 3A at 34. Thus formed, the leg 14 has the shelf supporting surface 36 and holes 38 may be formed in the shelf support surface 36 to enable a shelf to be securely screwed to the leg 14. Additionally, when the shelf support has been formed, the hooks 30 of the formed shelf support leg 14 are aligned with each other and provide a support for a transversely extending clothes supporting pole. Similarly, the tangs 32 also align with each other and are adapted to embrace the sidewalls 12A, 12B at the upper end 22 of the wall mounting leg 12. The tangs 32 are formed with holes 40 arranged to align with holes (not shown) in the upper end of the sidewalls 12A, 12B of the wall mounting leg 12, the aligned holes receiving the first pivot pin 28.

Figure 2A:
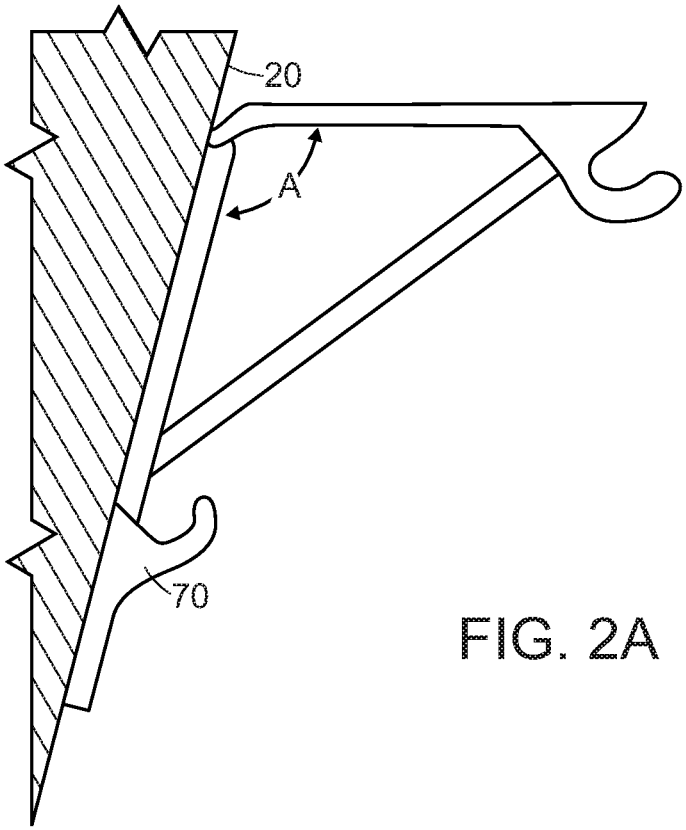
FIGS. 2A and 2B are side views of the bracket used with walls or other angled surfaces having varied sloping angles.
Figure 2B:
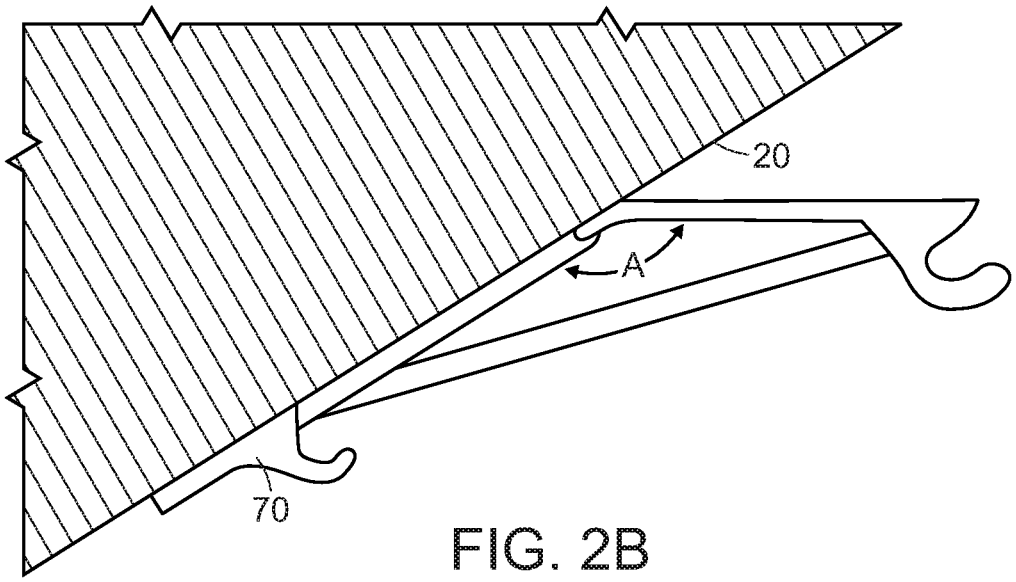

The bracing leg 16 is pivoted, at a second pivot pin 42, to the forward portion 26 of the shelf-supporting leg 14 and at its other end to a lower portion of the mounting leg 12, as at a third pivot pin 44. The bracing leg 16 is adjustable in length so that it can accommodate a range of obtuse angles A between the mounting and shelf-supporting legs 12, 14 and a locking arrangement is provided by which the bracing leg 16 can be securely locked in a selected one of a plurality of positions. FIGS. 2 and 2A illustrate, how the shelf bracket is adjustable to accommodate sloped walls and angled surfaces having different sloping angles.

Figure 4:
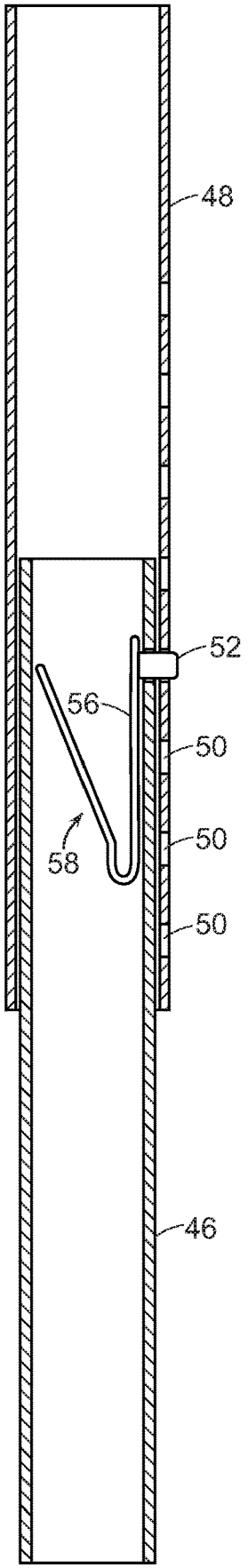
FIG. 4 is a longitudinal sectional illustration of the bracing leg showing an illustrative locking mechanism for the bracing leg.

The bracing leg 16 should be formed to have good compressive strength and, preferably, may be formed from a pair of telescoped tubes such as an inner tube 46 slidably received in an outer tube 48. As shown in FIG. 4 the locking arrangement may include a longitudinally extending row of locking holes 50 formed along the outer tube 46 and a resiliently mounted button 52 mounted within the inner tube 46 and protruding through a single button hole 54 formed in the inner tube 46 and aligned with the row of locking holes 50. The tubes 46, 48 are arranged so that the button 52 can be depressed to allow the tubes to be telescopically adjusted to a position in which the shelf support leg is horizontal. The button then can be released to protrude through a selected of the locking holes to lock the tubes 46, 48 in that position. The button 52 may be formed on an end of a leg 56 of a U-shaped spring 58 that biases the button 52 outwardly through the button hole 54.

Figure 5:
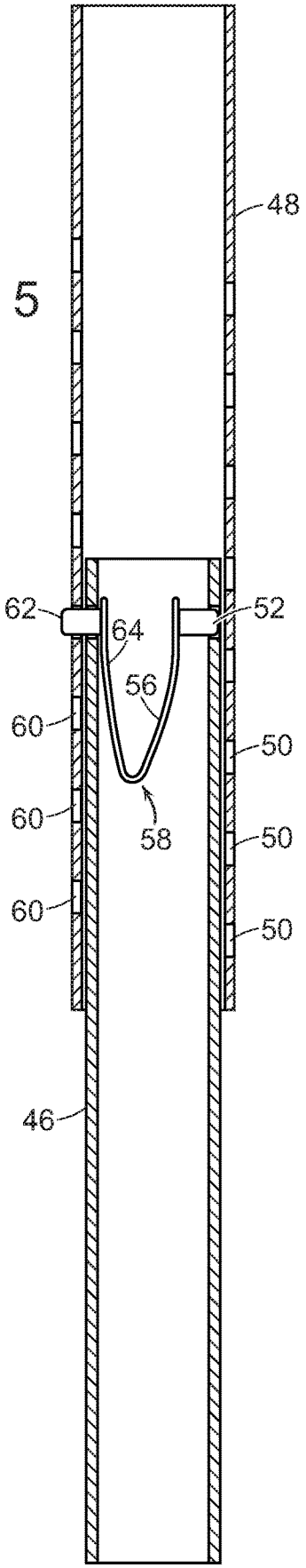
FIG. 5 is an illustration of modified locking mechanism having finer adjustment capability.

FIG. 5 shows a modified form of locking arrangement in which the telescoping tubes can be provided with a finer degree of adjustment. In this embodiment a second row of locking holes 60 is provided on the outer tube 46, with the holes 60 being located on the diametrically opposite side of the outer tube 46 from the first row of holes 50. The locking holes 60 are spaced along the outer tube 46 so that their centers are out of registry with the holes 50 of the first row. In this embodiment a second button 62 is secured to the other leg 64 of the U-shaped spring 58 and protrudes into a second button hole 66 in the inner tube 44, the button holes 54, 66 being disposed diametrically opposite each other. From the foregoing it will be appreciated that only one of the two buttons 52, 62 can be in engagement with a locking hole 50 or 60 at a time. When the button 52 is in engagement with a locking hole 50, the other button 62, although protruding through its button hole 66, will bear against a portion of the inner surface of the outer tube disposed between a pair of locking holes 60. Similarly, when the button 62 is in engagement with one of its locking holes 60, the other button 52, although protruding through its button hole 54, will bear against a portion of the inner surface of the outer tube disposed between a pair of locking holes 50. The arrangement enables the length of the bracing leg 16 to be more finely adjusted that with a single row of locking holes.

As shown in FIGS. 1, 1A, 2A and 2B, the shelving support can incorporate a second, lower clothes pole support 70. The pole support 70 of each bracket may be formed from a flat sheet of metal in a pattern as indicated in FIG. 3B. The pattern may be considered to include a hook end at which a pair of mirror image hooks 72 are formed. The sheet metal pattern is intended to be folded along a pair of parallel fold lines 74 to define a channel-shaped cross-section that includes a pair of side skirts 76 connected by a web 78. The side skirts are spaced sufficiently so that they can fit over mounting leg 12. The lower pole support 70 may have at least one, and preferably two oblong holes 80 that be aligned with the holes 18 in the mounting leg 12 to secure the pole support 70 between the mounting leg and the surface to which the bracket is attached. The additional pole support is optional.

It should be understood that the foregoing description of the invention is intended merely to be illustrative thereof and that other embodiments, modifications and equivalents may be apparent to those skilled in the art without departing from the principles of the invention.

Having thus described the invention, I claim:

1. A shelving bracket comprising:

an elongate mounting leg adapted to be securely fastened to a structural non-vertical support structure;

a shelf-supporting leg having first and second ends, the first end of the shelf-supporting leg being pivotally connected to an upper portion of the mounting leg at a first pivot;

a bracing leg having first and second ends, the first end of the bracing leg being pivoted to the shelf-supporting leg at a second pivot, the second end of the bracing leg being pivoted to the mounting leg at a third pivot;

the bracing leg being adjustable in length to enable the angle between the mounting leg and the shelf-supporting leg to be varied, the bracing leg comprising an outer tube and an inner tube telescopically received in the outer tube;

locking structure for locking the bracing leg in a selected of a plurality of lengths, the locking structure comprising a first row of a plurality of linearly aligned locking holes formed along the length of the outer tube and a first button hole in the inner tube, the tubes being oriented relative to each other to enable the first button hole to be aligned with a selected one of the plurality of locking holes in the first row, the locking structure further comprising a first locking button carried within the inner tube in alignment with the first button hole and being biased radially outwardly whereby the first button can protrude through the first button hole into engagement with a selected of the locking holes of the first row to lock the bracing leg in a selected configuration;

a second row of linearly aligned locking holes formed along the length of the outer tube opposite the first row;

the inner tube having a second button hole in alignment with the second row of locking holes;

the locking holes in the second row being in longitudinally staggered relation to the locking holes in the first row; and a second button carried within the inner tube in alignment with the second button hole and being biased radially outwardly whereby the second button can protrude through the second button hole into engagement with a selected of the locking holes in the second row, the staggered relation of the locking holes in the first and second row enabling only one of the buttons to be in engagement with one of the locking holes at a time.

2. The shelving bracket as defined in claim 1 wherein the rows of locking holes are long enough to enable the shelf-supporting leg and the mounting leg to be pivoted between an acute and an obtuse angle whereby the mounting leg may be secured to a non-vertical surface and the shelf-supporting leg can be oriented to be horizontal.

3. The shelving bracket as defined in claim 1 wherein the locking structure further comprises:

a resilient U-shaped spring having a pair of legs contained in the inner tube with its legs biased radially outwardly, the first button being attached to an end of one of the spring legs and the second button being attached to the end of the other of the spring legs.

4. The shelving bracket as defined in claim 1 further comprising a pole hook formed integrally with the outer end of the shelf-supporting surface.

5. The shelving bracket as defined in claim 1 further comprising a pole hook attached to the lower end of the mounting leg.

6. A shelving bracket comprising:

an elongate mounting leg adapted to be securely fastened to a structural non-vertical support structure;

a shelf-supporting leg having first and second ends, the first end of the shelf-supporting leg being pivotally connected to an upper portion of the mounting leg at a first pivot;

a bracing leg having first and second ends, the first end of the bracing leg being pivoted to the shelf-supporting leg at a second pivot, the second end of the bracing leg being pivoted to the mounting leg at a third pivot;

the bracing leg being adjustable in length to enable the angle between the mounting leg and the shelf-supporting leg to be varied wherein the shelf supporting leg is channel-shaped in cross-section having a longitudinally extending shelf-support web and a pair of spaced sidewalls extending downwardly from the web, the first pivot being mounted to the sidewalls, and a pole hook formed integrally with and in one piece with at least one of the sidewalls of the shelf supporting leg.

7. The shelving bracket as defined in claim 6 further comprising each of the sidewalls of the shelf supporting leg having a pole hook formed integrally and in one piece with the outer end of the sidewall.

8. The shelving bracket as defined in claim 6 wherein the mounting leg is channel-shaped in cross-section having a longitudinally extending web and a pair of sidewalls extending from the web, the second pivot being mounted to the sidewalls.

9. The shelving bracket as defined in claim 8 further comprising a lower pole hook attachment mounted to the lower end of the mounting leg, the pole hook attachment being channel-shaped having a web and a pair of spaced skirts extending from the web, each of the skirts comprising a hook shaped member formed integrally and in one piece with and extending from each of the skirts, the skirts being spaced to receive the channel-shaped mounting leg therebetween.

10. The shelving bracket as defined in claim 6 wherein the mounting leg is channel-shaped in cross-section having a longitudinally extending mounting web and a pair of sidewalls, the second pivot being mounted to the sidewalls.

11. The shelving bracket as defined in claim 1 wherein the second row of holes is diametrically opposite the first row; and the spacing between the locking holes in the first row is the same as the spacing of the locking holes in the second row.

* * * * *